US005868885A

United States Patent [19]

Crockett et al.

[11] Patent Number: 5,868,885

[45] Date of Patent: Feb. 9, 1999

[54] MANUFACTURE OF CUTTING TOOLS

[75] Inventors: Ronald B. Crockett, Orem; Scott M. Packer, Pleasant Grove; Richard L. Dixon, Provo; Nathan R. Anderson, Pleasant Grove; Ronald K. Eyre, Orem; Madapusi K. Keshavan; Ghanshyan Rai, both of Sandy, all of Utah

[73] Assignee: Smith International, Inc., Houston, Tex.

[21] Appl. No.: 782,543

[22] Filed: Jan. 10, 1997

Related U.S. Application Data

[63] Continuation-in-part of Ser. No. 568,276, Dec. 6, 1995, Pat. No. 5,766,394.

[60] Provisional application No. 60/003,466 Sep. 8, 1995.

[51] Int. Cl.[6] ..... B32B 31/26; B21K 5/04

[52] U.S. Cl. ..... 156/89.27; 156/89.11; 156/89.25; 156/259; 156/264; 156/293; 51/297; 76/108.1; 76/DIG. 11; 76/DIG. 12

[58] Field of Search ..... 51/297, 307; 76/5.1, 76/108.1, 108.4, 108.6, DIG. 12, DIG. 11; 156/89, 293, 264, 259, 89.11, 89.25, 89.27

[56] References Cited

U.S. PATENT DOCUMENTS

| | | | |
|---|---|---|---|
| 3,574,580 | 4/1971 | Stromberg et al. | 51/307 |
| 3,743,566 | 7/1973 | Breton et al. | 156/62.8 |
| 3,778,586 | 12/1973 | Breton et al. | 219/76 |
| 4,104,441 | 8/1978 | Fedoseev et al. | 264/109 X |
| 4,194,949 | 3/1980 | Breton et al. | 428/308 |
| 4,713,286 | 12/1987 | Bunting et al. | 428/323 |
| 4,762,445 | 8/1988 | Bunting et al. | 408/144 |
| 4,861,350 | 8/1989 | Phaal et al. | 51/295 X |
| 4,866,885 | 9/1989 | Dodsworth . | |
| 4,931,068 | 6/1990 | Dismukes et al. | 51/293 |
| 4,991,467 | 2/1991 | Packer | 76/108.6 |
| 5,031,484 | 7/1991 | Packer | 76/108.6 |
| 5,037,451 | 8/1991 | Burnand et al. | 51/293 |
| 5,070,748 | 12/1991 | Packer | 76/108.6 |
| 5,089,070 | 2/1992 | McAndrew | 156/89 |
| 5,115,697 | 5/1992 | Rodriguez et al. | 76/108.6 |
| 5,211,726 | 5/1993 | Slutz et al. | 51/293 |
| 5,248,317 | 9/1993 | Tank et al. | 51/293 |
| 5,271,877 | 12/1993 | Matsumae et al. . | |
| 5,273,379 | 12/1993 | Nishimura | 76/108.6 X |
| 5,297,456 | 3/1994 | Nishimura | 76/108.6 |
| 5,379,853 | 1/1995 | Lockwood et al. | 51/307 X |
| 5,468,268 | 11/1995 | Tank et al. | 51/293 |
| 5,499,688 | 3/1996 | Dennis | 175/426 |
| 5,611,251 | 3/1997 | Katayama | 76/108.6 |
| 5,697,994 | 12/1997 | Packer et al. | 51/307 X |

FOREIGN PATENT DOCUMENTS 1212681 11/1970 United Kingdom .

OTHER PUBLICATIONS

Ragan Technologies Incorporated, High Shear Compaxtion Technology; 14 pages.

Ragan Technologies Inc. Presents . . . ZST . . . LTCC; 9 pages.

A New Hardfacing Process, Dustoor,et al, Imperial Clevite Inc., 1982 National Powder Metallurgy Conference, Montreal, Can. May 24–27; Progress in Powder Metallurgy, vol. 38, pp. 1–16.

Air Products and Chemicals, Inc.—QPAC Binders, 12 pages; Laboratory Report, The Role of Slip Additives in Tape–Casting Technology, vol. 71, #10, Oct. 1992.

*Primary Examiner*—Curtis Mayes
*Attorney, Agent, or Firm*—Christie, Parker & Hale, LLP

[57] ABSTRACT

A method for manufacturing cutting tools having diamond-like cutting edges or surfaces which are formed by bonding high shear compaction diamond or cubic boron nitride (CBN) ropes or strips in helical grooves formed on the cutting tool outer surface. The strips are formed by slitting a sheet of high shear compaction diamond or CBN material. The ropes are formed by rolling the strips between grooved rollers.

45 Claims, 2 Drawing Sheets

MANUFACTURE OF CUTTING TOOLS

This is a continuation-in-part of application Ser. No. 08/568,276, filed Dec. 6, 1995, now U.S. Pat. No. 5,766,394, which is based on Provisional Application No. 60/003,466, filed Sep. 8, 1995.

BACKGROUND OF THE INVENTION

This invention relates to a method for forming cutting tools and specifically rotary cutting tools with diamond-like cutting edges and inserts for drag bits with diamond-like secondary cutting surfaces which are formed by bonding high shear compaction diamond-like rope or strip material in helical grooves formed on the cutting tool bodies. "Diamond-like" as used herein refers to ultra hard materials including diamond and cubic boron nitride (CBN).

Rotary cutting tools are used in a variety of machining operations. Helically fluted end mills and ball end mills are commonly used rotary cutting tools and are generally required to perform severe machining operations under adverse conditions, as well as, finishing operations where a fine surface is desired. The cutting end of a helically fluted end mill, for example, includes at least one cutting edge on the end mill blank. The cutting end of a ball end mill carries the cutting edge around the ball end of the mill. Other types of rotary cutting tools include diamond twist drills, composite sintered twist drills, printed circuit board drills, reamers and taps.

Similarly, inserts with secondary cutting surfaces formed on a side surface of the insert substrate (body) are used as the cutting elements in a drag bit. The primary cutting surface of drag bit insert is typically a diamond layer 140 sintered on a face of the insert body (FIG. 6). The secondary cutting surfaces are formed by packing and sintering diamond crystals (or CBN) in grooves formed on the substrate (body).

The cutting tools have cutting surfaces formed by sintering a diamond-like material on grooves formed on their outer surfaces. After sintering, the diamond-like material is machined to form a sharp cutting surface edge. Compaction is required to ensure sufficient density of diamond within the groove to minimize material shrinkage during the sintering process. An increase in the density of the diamond-like material improves the impact resistance or toughness, wear resistance and material uniformity of the cutting surface. Current methods of compacting the diamond-like material are complex resulting in quality inconsistencies between cutting surfaces.

Accordingly there is a need for a method for manufacturing cutting tools where a high compaction of the diamond-like material is easily achieved, minimizing the shrinkage of the diamond-like material during the sintering process, resulting in improved impact resistance or toughness, wear resistance, and uniformity.

BRIEF SUMMARY OF THE INVENTION

This invention relates to a method for manufacturing cutting tools having diamond-like cutting surfaces. Grooves are formed in the outer surface of the cutting tool body. The invention can be used to form secondary cutting surfaces on the body of a drag bit insert as well as cutting edges on a rotary cutting tool such as an end mill. The grooves are preferably concave and may, for example, have a semicircular cross section bottom. Moreover, the grooves may have a wavy surface. Typically the body of the cutting tool is formed form a hard and tough material such as cemented tungsten carbide. A rope or strip formed from a high shear compaction of diamond or cubic boron nitride sheet is placed in the groove. The rope or strip may also be formed from tape diamond-like material which is formed by doctor blade or other processes such as extrusion. The body and rope (or strip) are processed at high temperature and pressure to form and bond polycrystalline diamond (PCD) or polycrystalline cubic boron nitride (PCBN) rope (or strip) to the carbide body. Afterwards, the bonded PCD or PCBN is ground forming cutting edges. In the case of rotary cutting tools, flutes may also be machined on the cutter body outer surface at this time.

The strips are formed by slitting a sheet of high shear compaction diamond-like material or other tape diamond-like material such as tape formed by doctor blade, extrusion or other similar processes. The ropes are formed by rolling the strips between grooved rollers. The strips may also be rolled between a flat roller and a grooved roller to form ropes having a surface complementary to the groove. The strips or ropes have less shrinkage upon high temperature, high pressure processing than diamond crystals packed into a groove.

DETAILED DESCRIPTION

For descriptive purposes, the method of manufacturing cutting tools is described herein in reference to an end mill. As it will be come apparent to one skilled in the art, the method can be used in the manufacture of other cutting tools having diamond like cutting surfaces. Such cutting tools include, but are not limited to, drag bit inserts as well as rotary cutting tools such as various types of end mills (e.g., ball end mills), diamond twist drills, composite sintered twist drills, printed circuit board drills, reamers and taps.

As used herein "diamond like" refers to ultra hard materials such as diamond or cubic boron nitride.

Figure 1:
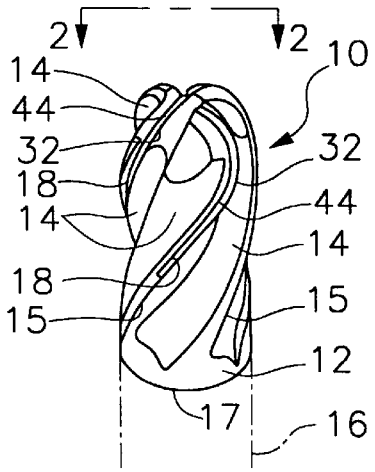
FIG. 1 is an isometric view of an end mill.
Figure 2:
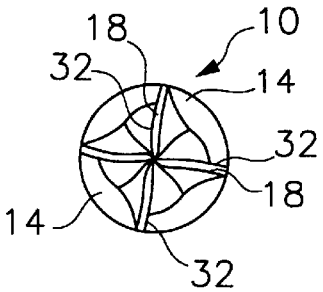
FIG. 2 is a top view of the end mill depicted in FIG. 1.
Figure 6:
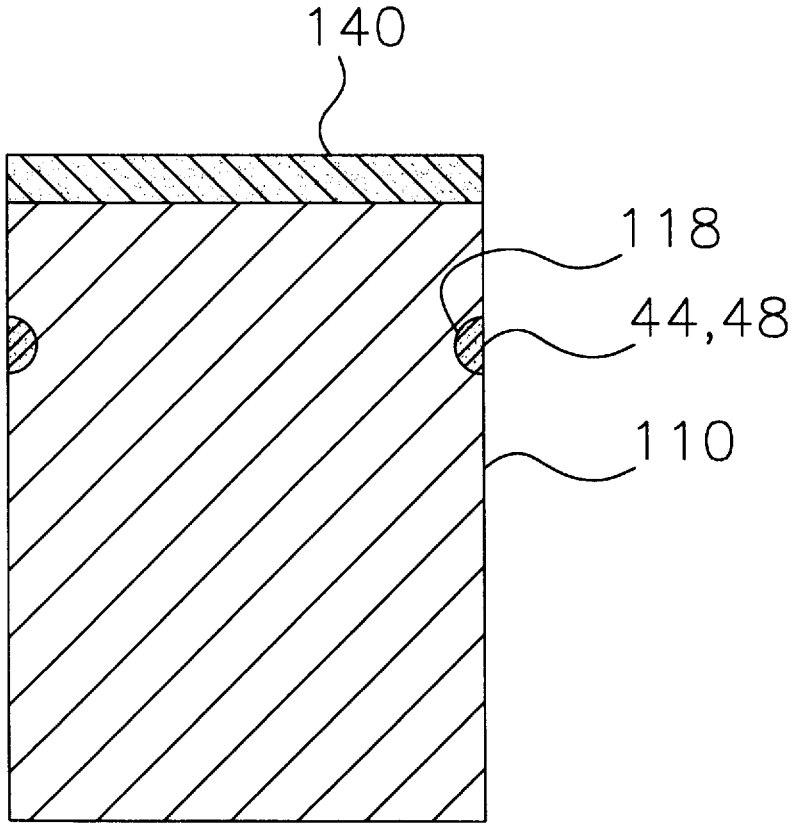
FIG. 6 is a cross sectional view of a drag bit insert with a secondary cutting surface formed on its side.

The PCD or PCBN ball end mill of FIGS. 1 and 2 generally designated as 10 comprises an end mill body 12 having, for example, four helical flutes 14 circumferentially and equidistantly spaced around the body. The body of the ball mill may, for example, be fabricated from a hard and tough material such as cemented tungsten carbide. A groove 18 is formed in the leading edge 15 of the flutes 14. Typically the groove is concave. As such and as can be seen in FIGS. 1 and 6, the groove typically has a compound curvature, i.e., it curves in two directions. For example, the grooves shown in FIGS. 1 and 6 curve in cross-section and along their length.

With drag bit inserts (shown in FIG. 6) the method is used to form secondary cutting surfaces on the cutter body outer surface. The insert body may, for example, be fabricated from a hard and tough material such as cemented tungsten carbide. At least one, typically concave, groove 118 is formed on the outer surface of the insert body 110. Is some instances the groove may have a wavy surface.

Figure 4:
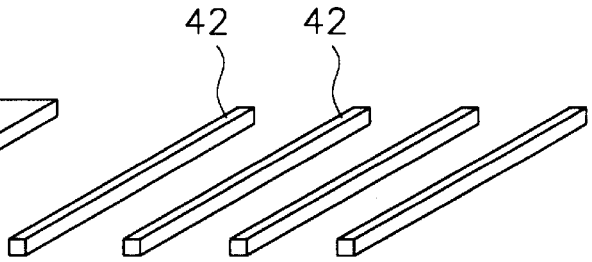
FIG. 4 is an isometric view of a high shear compaction sheet of FIG. 3 slit into strips.
Figure 5:
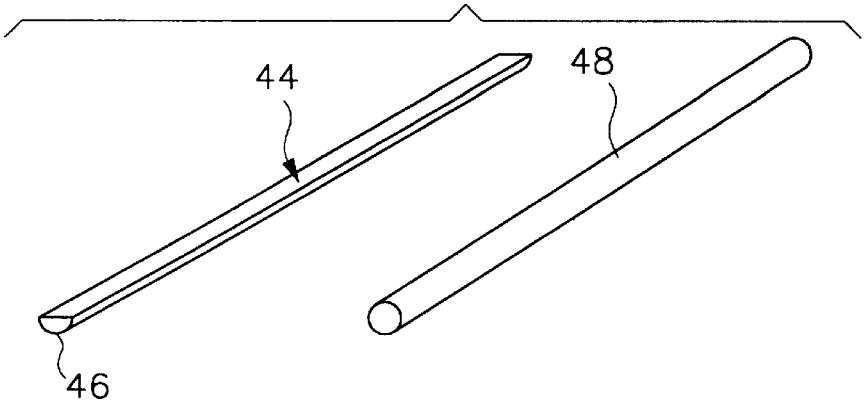
FIG. 5 is an isometric view of a ropes formed by rolling the strips shown in FIG. 4 having semicircular and circular cross sections.

In a preferred embodiment, a rope 44, 48 (FIGS. 5) formed from a high shear compaction diamond-like material, i.e., particle diamond or cubic boron nitride (CBN), sheet is placed in the groove. In an alternate embodiment, the rope may be pressed into the groove. In a further embodiment, a strip 42 (FIG. 4) of a high shear compaction diamond or CBN sheet is draped into the groove. The strip may be draped or pressed into the groove or may be first shaped into a shape complementary to the groove and then pressed into the groove. In further embodiments, the rope or strip to be draped or pressed in a groove, may be formed from a tape of diamond-like material which is formed by doctor blade or extrusion or other similar processes. As it will become apparent from the description herein, "rope" is used to refer to a string-like structure, not a braided structure.

The body and rope (or strip) assembly are then processed at high temperature and pressure wherein the diamond or CBN particles within the rope (or strip) form polycrystalline diamond (PCD) or polycrystalline cubic boron nitride (PCBN) and bond to the carbide tool body forming veins of PCD or PCBN. Afterwards, cutting edges 32 are ground into the bonded PCD or PCBN rope (or strip) material 44 in the grooves 18 in the end mill body 12. The tungsten carbide end mill body may then be metallurgically bonded to a steel or carbide shank 16 along a juncture 17. The metallurgical bond may, for example, be a braze.

Figure 3:
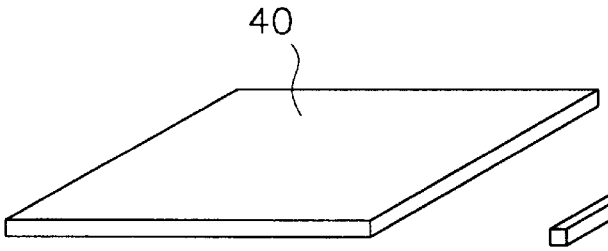
FIG. 3 is an isometric view of a high shear compaction sheet of diamond-like material.

The strips 42 are formed by slitting a sheet of high shear compaction material 40 (FIG. 3) processed by Ragan Technologies, 11696 Sorrento Valley Road, Suite D, San Diego, Calif. 92121. The details for forming a high shear compaction layer are described in application Ser. No. 08/568,276 now U.S. Pat. No. 5,766,394, which is incorporated herein by reference. These narrow strips can be rolled between grooved rollers and reformed into ropes 44, 48.

The strips can be readily draped into grooves and have less shrinkage upon high temperature, high pressure processing than diamond crystals packed into a groove. In the preferred embodiment, the strips are rolled between a flat roller and a grooved roller to form ropes 44 having a surface 46 complementary to the grooves 18 to allow the rope to fit within the groove. For example, if the groove has a semicircular bottom, the rope will have a complementary semicircular cross section.

The high shear compaction material sheet which is slit into strips is composed of particles of ultra hard material such as diamond or CBN, an organic binder such as polypropylene carbonate and possibly residual solvents such as methyl ethyl ketone (MEK). The sheet of high shear compaction material is prepared in a multiple roller process. For example, a first rolling in a multiple roller high shear compaction process produces a sheet approximately 0.25 mm thick. The sheet is then lapped over itself and rolled for a second time, producing a sheet of about 0.45 mm in thickness. The sheet may either be folded or cut and stacked to have multiple layer thickness.

This compaction process produces a high shear in the sheet and results in extensive mastication of the ultra hard particles, breaking off corners and edges but not cleaving them and creating a volume of relatively smaller particles in situ. This process also results in thorough mixing of the particles, which produces a uniform distribution of the larger and smaller particles throughout the high shear compaction material. The breakage rounds the particles without cleaving substantial numbers of the particles.

Also, high shear during the rolling process produces a sheet of high density, i.e. about 2.5 to 2.7 g/cm$^3$, and preferably about 2.6±0.05 g/cm$^3$. This density is characteristic of a sheet having about 80% by weight diamond crystals and 20% organic binder. At times, it is desirable to include tungsten carbide particles and/or cobalt in the sheet. There may also be times when a higher proportion of binder and lower proportion of diamond particles may be present in the sheet for enhanced "drapability". For example, enhanced drapability may be desired when strips rather than ropes are used to fill in the grooves. The enhanced drapability would allow the strip to better conform to the shape of the groove. The desired density of the sheet can be adjusted proportionately and an equivalent sheet produced.

The sheet and consequently the ropes (or strips) of high shear compaction material are characterized by a high green density resulting in low shrinkage during firing, and by ultra high hardness and uniform particle distribution improving the results obtained from the high temperature high pressure process, i.e., improved impact resistance, wear resistance and uniformity. Due to the extra rolling process required to form a rope from a strip, a rope may have a higher material density then a strip.

The sheet material is made by multiple roller process so that the diamonds (or CBN) are subjected to considerable shear and mastication as the material passes between rotating rolls. The high shear compaction of the sheet abrades diamond crystals against each other, thereby somewhat reducing the particle size. The lubrication and suspension provided by the organic binder phase is believed to contribute to the high shear extending essentially through the entire thickness of the layer for uniform treatment of the diamond crystals.

The abrasion of particles against each other results in breakage which may include cleavage of crystals and fractures of corners and edges which are knocked off of larger crystals as a consequence of the high shear processing of the high shear compaction sheet. It is found to be desirable to limit the mastication to have breakage of corners and edges to produce equiaxed or rounded particles instead of cleavage which produces angular particles with lower surface energy.

A multimodal particle size distribution is also desirable in the sheet to be employed for forming polycrystalline diamond. It is known, for example, that there is better packing density in a powder mixture when there are two or more different sizes of particles instead of particles that are all one size. To achieve multimodal particle size distribution for high packing density, mixtures of larger and smaller particles may be employed. Formation of rounded particles and smaller particles from the corners and edges by high shear compaction is preferred, particularly since this also provides residual carbon formed in situ in the layer of ultra hard materials.

Once, the high shear compaction material rope (or strip) is in place in a groove on the cutter body, the organic binder in the high shear compaction material rope (or strip) is removed (or "volatilized"), leaving the diamond crystals in the groove. Preferably, this is accomplished by heating the body and rope (or strip) assembly in vacuum, preferably 10 to $10^{-5}$ torr, at a temperature of about 1025° C. Heating may also be in an inert or reducing gas such as argon or ammonia. The latter may be beneficial when the ultra hard material in the rope (or strip) is CBN.

Conventional dewaxing (volatilizing) practice for removing organic binder from high shear compaction materials has been to heat at temperatures in the order of 300° to 600° C. Surprisingly, it has been found that by heating at temperatures of at least 950° C., there are significantly enhanced results due to the high temperature processing. The reasons for this are not completely understood, however, it is believed that the enhanced results are a consequence of thermal decomposition of the binder material and deoxidation by residual carbon.

The temperature for pretreating the high shear compaction material containing ultra hard particles is preferably 950° C. or more. It has been found, for example, that heating in vacuum at 950° C. for several hours is suitable for diamond containing material. A temperature of 1025° C. for a shorter period also gives good results. A higher temperature may be used for cubic boron nitride particles and it may be desirable to heat CBN in ammonia for maintaining stoichiometry of the CBN and reducing surface oxides. It has also been found that heating rate can be significant and a low heating rate is desirable. It is believed that vaporization of volatile materials in the binder may lead to minute "blistering" at high heating rates. Volatiles produced in the dewaxing may not escape readily from the high shear compaction rope (or strip) and cause delamination. Significantly improved results are obtained with a heating rate of about 2° C. per minute as compared with a heating rate of about 5° C. per minute.

After dewaxing (volatilizing), the rope (or strip) of ultra hard material is heated to a much higher temperature for reducing oxides formed before or during the high shear compaction process. The reduction of oxides is facilitated by residual carbon on the particles formed by decomposition of the organic binder materials. For diamond a temperature of at least 950° C. is important. A higher temperature may be used with cubic boron nitride. Carbon on cubic boron nitride particles also facilitates deoxidation.

The carbide body and rope (or strip) assembly is then placed in a super pressure press where it is pressed at pressures where diamond is thermodynamically stable, such as in excess of 35 kilobars and as much as 65 kilobars. While maintaining such high pressures, the material in the press is heated to elevated temperature for a short period until polycrystalline diamond is formed. During this heating cycle, cobalt included in the diamond particle mixture or infiltrated from the cemented tungsten carbide is present within the mass of diamonds. To form polycrystalline diamond and have grain growth, there is mass transfer of carbon. The solubility of carbon in the liquid cobalt phase promotes such recrystallization and consolidation of the polycrystalline diamond.

This process results in strong bond between the rope (or strip) and the carbide body. Shrinkage of the material in the groove is minimized by use of high density material rope (or strip). There is still sufficient shrinkage, however, that the circumferential surface of the finished cutter can be ground to its final diameter with minimal grinding of the PCD or PCBN in the groove. This is advantageous since the carbide can be ground more readily than diamond.

Moreover, once the PCD or PCBN rope (or strip) is bonded to the groove, the PCD or PCBN cutting edge can be formed by methods which include grinding, wire electrical discharge cutting (wire EDM), and electrical discharge grinding (EDG). In cases of rotary cutting tools, the flutes 14 may also be formed in the mill body after the high compaction PCD or PCBN ropes (or strips) are bonded within the grooves 18.

The specific configuration of diamond rope (or strip) filled grooves on the end face of an end mill or the like, depends on the purpose for which the mill is to be used. For example, different numbers of flutes and cutting edges may be desirable, depending on whether the mill is to be used for rough machining or obtaining a fine finish. The material for which the mill is to be used also affects the geometry of cutting edges.

Although this invention has been described in certain specific embodiments, many additional modifications and variations will be apparent to those skilled in the art. It is therefore, to be understood that within the scope of the appended claims, this invention may be practiced otherwise than as specifically described.

What is claimed is:

1. A process for forming a cutting surface on a cutting tool having a body surface, the process comprising the steps of:

forming at least one groove on the body surface, the groove extending from the cutting end toward the base end;

forming a rope from a sheet of commingled ultra hard particles and a binder;

placing the rope in the groove forming a body and rope assembly; and bonding the rope in the groove for forming a cutting surface of polycrystalline diamond-like material in the groove.

2. A process as recited in claim 1 further comprising the step of forming a flute along the leading edge of the cutting surface of diamond-like material for forming a cutting edge along the leading edge of the diamond like material.

3. A process as recited in claim 1 wherein the forming at least one groove step further comprises the step of forming the body surface from cemented tungsten carbide.

4. A process as recited in claim 1 wherein the forming a rope step comprises the steps of:

forming a sheet of high shear compaction diamond-like material by roller pressing diamond-like material with a binder;

slitting the sheet into strips;

rolling each strip along its longitudinal axis through rollers to form a rope.

5. A process as recited in claim 4 wherein the forming a sheet step comprises forming a sheet of high shear compaction cubic boron nitride.

6. A process as recited in claim 1 wherein the forming a rope step comprises the steps of:

forming a tape of diamond-like material by a process selected from the group consisting of doctor blade forming and extruding;

slitting the tape into strips;

rolling each strip along its longitudinal axis through rollers to form a rope.

7. A process as recited in claim 6 wherein the forming a tape step comprises forming a tape of cubic boron nitride.

8. A process as recited in claim 1 wherein the groove is concave.

9. A process as recited in claim 1 wherein the groove has a wavy surface.

10. A process as recited in claim 1 wherein the forming a rope step comprises forming a rope having a surface complementary to the groove.

11. A process as recited in claim 10 wherein the step of forming a rope comprises the step of slitting a sheet of commingled ultra hard material and binder into strips and rolling each strip along its longitudinal axis between a flat and a grooved roller.

12. A process as recited in claim 1 wherein the bonding step comprises the steps of:

volatilizing the binder by heating the body and rope assembly;

pressing the body and rope assembly at pressures where diamond is thermodynamically stable; and heating the body and rope assembly until polycrystalline diamond is formed whereby the polycrystalline diamond bonds to the cutter body.

13. A process as recited in claim 12 wherein the volatilizing step comprises heating the body and rope assembly in a vacuum.

14. A process as recited in claim 13 wherein the vacuum is not greater than 10 torr and not less than $10^{-5}$ torr.

15. A process as recited in claim 12 wherein the volatilizing step comprises heating the body and rope assembly in an inert gas or reducing gas.

16. A process as recited in claim 15 wherein the volatilizing step comprises heating the body and rope assembly in a gas selected from the group consisting of ammonia and argon.

17. A process as recited in claim 12 wherein the forming the rope step comprises forming the rope from diamond or cubic boron nitride material and wherein the volatilizing step comprises heating the assembly at temperature of at least 300° C.

18. A process as recited in claim 12 wherein the step of forming the rope comprises forming the rope from a material selected from the group consisting of diamond and cubic boron nitride and wherein the step of volatilizing comprises heating the assembly at temperature of at least 950° C.

19. A process as recited in claim 12 wherein the pressing step comprises pressing the body and rope assembly at pressures of at least 35 kilobars.

20. A process as recited in claim 19 wherein the pressing step comprises pressing the body and rope assembly at a pressure of approximately 65 kilobars.

21. A process as recited in claim 12 further comprising, prior to the step of pressing, the step of heating the body and rope assembly to a temperature of at least equal to the temperature to which the assembly was heated during the volatilizing step.

22. A process as recited in claim 21 wherein the step of heating occurring prior to the step of pressing comprises heating the body and rope assembly to a temperature of at least 950° C.

23. A process for forming a cutting surface on a cutting tool having a body, the process comprising the steps of:

forming at least one groove having a bottom on the cutting tool body;

forming a rope of diamond-like material, the rope having a surface complementary to the bottom of the groove;

placing the rope within the groove, mating the complementary surface of the rope to the groove bottom; and sintering rope within the groove, forming a cutting surface of polycrystalline diamond-like material in the groove.

24. A process as recited in claim 23 wherein the step of forming a rope, comprises the step of forming a rope from high shear compaction diamond-like material.

25. A process as recited in claim 23 wherein the step of forming a rope comprises the step of forming a rope from a tape of diamond-like material, the tape being formed by a process selected from the group consisting of doctor blade forming and extruding.

26. A process as recited in claim 23 wherein the placing step comprises pressing the rope in the groove.

27. A process as recited in claim 23 further comprising the step of forming a flute along a leading edge of the surface of diamond-like material for forming a cutting edge along the leading edge of the diamond-like material.

28. A process for forming a cutting surface on a cutting tool having a body surface, the process comprising the steps of:

forming at least one groove on the body surface, the groove extending from the cutting end toward the base end;

forming a rope from a sheet of commingled ultra hard particles and a binder wherein the ultra hard material particles are selected from the group consisting of diamond and cubic boron nitride;

placing the rope in the groove forming a body and rope assembly;

volatilizing the binder by heating the body and rope assembly to a temperature of approximately 1025° C.;

pressing the body and rope assembly at pressures where diamond is thermodynamically stable; and heating the body and rope assembly until polycrystalline diamond is formed whereby the polycrystalline diamond bonds to the cutter body.

29. A process for forming a cutting surface on a cutting tool having a body outer surface, the process comprising the steps of:

forming at least one concave groove on the body outer surface;

draping the groove with a strip of diamond-like material shaped to a shape complementary to the groove; and bonding the strip in the groove in a high pressure-high temperature press for forming a cutting surface of polycrystalline diamond-like material in the groove.

30. A process as recited in claim 29 wherein the draping step comprises the step of draping the groove with a strip of high shear compaction diamond-like material.

31. A process as recited in claim 29 wherein the draping step comprises the step of draping the groove with a strip of tape diamond-like material, the tape being formed by a process selected from the group consisting of doctor blade forming and extruding.

32. A process as recited in claim 29 wherein the draping step comprises the step of pressing the strip into the groove.

33. A process as recited in claim 29 further comprising the step of forming a flute along a leading edge of the cutting surface of diamond-like material for forming a cutting edge along the leading edge of the diamond-like material.

34. A process for forming a cutting surface on a cutting tool having a body outer surface, the process comprising the steps of:

forming at least one groove on the body outer surface;

shaping a strip of diamond-like material into a shape complementary to the groove;

pressing the shaped strip into the groove; and bonding the strip in the groove in a high pressure-high temperature press for forming a cutting surface of polycrystalline diamond-like material in the groove.

35. A process for forming a rotary cutting tool comprising the steps of:

forming a cutting tool body of hard material;

forming at least one groove having compound curvature on the body surface;

forming a strip from a sheet of commingled ultra hard particles and a binder, the strip having a surface complementary to the groove;

placing the strip in the groove forming a body and strip assembly; and bonding the strip in the groove for forming polycrystalline diamond-like material in the groove.

36. A process as recited in claim 35 wherein the forming the body step comprises the step of forming the body from cemented tungsten carbide.

37. A process as recited in claim 35 wherein the forming a strip step comprises the steps of:

forming a sheet of high shear compaction diamond-like material by roller pressing diamond-like material with an organic binder; and slitting the sheet into strips.

38. A process as recited in claim 35 wherein the bonding step comprises the steps of:

volatilizing the binder by heating the body and strip assembly;

pressing the body and strip assembly at pressures where diamond is thermodynamically stable; and heating the body and strip assembly until polycrystalline diamond is formed whereby the polycrystalline diamond bonds in the groove in the cutter body.

39. A process for forming a rotary cutting tool comprising the steps of:

forming a cutting tool body of hard material;

forming at least one groove having compound curvature on the outer surface of the body;

forming a strip from high shear compaction diamond-like material comprising a binder, the strip having a surface complementary to the groove;

placing the strip within the groove; and sintering the strip within the groove, forming polycrystalline diamond-like material in the groove.

40. A process as recited in claim 39 wherein the placing step comprises pressing the strip in the groove.

41. A process for forming a cutting surface on a tool having a body, the process comprising the steps of:

slitting a sheet of diamond-like material for forming a narrow strip;

rolling the strip for forming a new cross sectional shape; and placing the rolled strip in a complementary groove in the body; and bonding the rolled strip in the groove in a high pressure-high temperature press for forming a cutting surface of a polycrystalline diamond-like material in the groove.

42. A process as recited in claim 41 wherein the step of slitting comprises the step of slitting a sheet of high shear compaction diamond like material.

43. A process as recited in claim 41 wherein the step of slitting comprises the step of slitting a tape of diamond-like material, the tape being formed by a process selected from the group consisting of doctor blade forming and extruding.

44. A process for forming a rotary cutting tool comprising the steps of:

forming a cutting tool body of hard material;

forming at least one groove on the body surface;

forming a sheet of high shear compaction ultra hard material having rounded particles by roller pressing ultra hard material with an organic binder;

slitting the sheet into strips;

placing a strip in the groove forming a body and strip assembly; and bonding the strip in the groove in a high pressure-high temperature press for forming polycrystalline ultra hard material in the groove.

45. A process as recited in claim 44 further comprising the step of shaping the strip to be placed in the groove into a shape complementary to the groove.

* * * * *